US005212851A

United States Patent [19]

Wantanabe

[11] Patent Number: 5,212,851

[45] Date of Patent: May 25, 1993

[54] SNAP-FIT BUTTON

[75] Inventor: Hirokazu Wantanabe, Toyama, Japan

[73] Assignee: Yoshida Kogyo K. K., Tokyo, Japan

[21] Appl. No.: 890,796

[22] Filed: Jun. 1, 1992

[30] Foreign Application Priority Data

May 31, 1991 [JP] Japan ..... 3-48741[U]

[51] Int. Cl.[5] ..... A44B 17/00

[52] U.S. Cl. ..... 24/108; 24/90 A; 24/674

[58] Field of Search ..... 24/108, 90 A, 95, 106, 24/113 MP, 662, 673, 674

[56] References Cited

U.S. PATENT DOCUMENTS

| | | | |
|---|---|---|---|
| 661,916 | 11/1900 | Liphard | 24/108 |
| 1,577,079 | 3/1926 | Ross et al. | 24/95 |
| 2,552,764 | 5/1951 | Bedford, Jr. | 24/674 |
| 2,983,975 | 5/1961 | Hubbell | 24/90 A |
| 3,414,949 | 12/1968 | Andrews | 24/90 A |
| 4,698,881 | 10/1987 | Watanabe | 24/674 |
| 4,941,234 | 7/1990 | Watanabe et al. | 24/90 A |
| 5,014,400 | 5/1991 | Ban . | |

FOREIGN PATENT DOCUMENTS

| | | | |
|---|---|---|---|
| 3336564 | 4/1985 | Fed. Rep. of Germany . | |
| 8516876 | 8/1985 | Fed. Rep. of Germany . | |
| 0701467 | 3/1931 | France | 24/108 |
| 63-42817 | 11/1988 | Japan . | |
| 2-268703 | 11/1990 | Japan . | |

*Primary Examiner*—Victor N. Sakran
*Attorney, Agent, or Firm*—Hill, Steadman & Simpson

[57] ABSTRACT

A snap-fit button comprising: a button body having on its front surface an ornamental; a snap member; a caulking member with which the button body and snap member are adapted to be caulked; a locking ring having on and along its outer peripheral portion a ridge and attached to a flange of the caulking member; a socket having an aperture for receiving the locking ring and having a taper diverging from an edge of the aperture toward a back surface of the button body, the socket being secured to the back surface of the button body; and a ring-shape spring disposed in the socket for resiliently engaging the locking ring.

2 Claims, 3 Drawing Sheets

SNAP-FIT BUTTON

BACKGROUND OF THE INVENTION

1. Field of the Invention

This invention relates to a snap-fit button adapted to be attached to a cloth by connecting a button body and snap member with a connecting member, the button body having an ornamental on its front surface.

2. Description of the Related Art

This type of snap-fit button is currently known in which a flange portion of a connecting member is secured to the back surface of a button body having an ornamental and in which the button body is adapted to be caulked with a female snap member with a cloth therebetween (Japanese Utility Model Publication No. 42817/1988). In another form, projections extending from one side of a locking ring are pierced through a cloth and are then clenched to one of male and female snap members, while projections extending from other side of the locking ring are secured to the other snap member. A button body having an ornamental is detachably attached to the male or female snap member on the cloth surface by snap-fitting (Japanese Patent Laid-Open Publication No. 268703/1990).

With the snap-fit button of the first-named publication, since the button body is attached to the cloth during the step of finishing a garment or the like, it is thereafter impossible to exchange the button body with another according to a customer's taste. In the snap-fit button of the second-named publication, since the button body is detachably attached to the male or female snap member by snap-fitting, the button body can be exchanged with another according to a customer's taste; however, the button body tends to be removed from the male/female snap member and would often be missing.

SUMMARY OF THE INVENTION

It is therefore an object of this invention to provide a snap-fit button which a button body having an ornamental can be selected according to a customer's taste when the customer purchases a garment or the like an in which once the selected button body is joined with a locking ring attached to the cloth, it can no longer be removed.

According to this invention, there is provided a snap-fit button of the type in which a button body having its front surface an ornamental and a snap member are adapted to be connected with a connecting member, characterized in that a locking ring having on an along its outer peripheral portion a ridge is attached to a flange of the connecting member, that a socket having an aperture for receiving the locking ring and having a taper diverging from an edge of the aperture toward a back surface of the button body is secured to the back surface of the button body, and that a ring-shape spring engageable with the locking ring is disposed in the socket.

Further, the back surface of the button has an annular recess which is contacted with the heat portion of the locking ring when the locking ring is inserted in the aperture of the socket.

In operation, the cloth of a garment or the like is sandwiched between the snap member and the locking ring, which is attached to the flange portion of the connecting member; unlike the prior art button, the button body does not serve to directly sandwich the cloth. The locking ring is inserted in the aperture of the socket secured to the back surface of the button body, engaging the ring-shape spring, which is movable along the taper diverging from the edge of the aperture toward the back surface of the button body. After this engagement, the locking ring even when pulled can no longer be removed from the button body as the ring-shape spring is moved toward the aperture along the slant surface of the socket to be pressed against the socket and hence to become much harder. Since the back surface of the button body has an annular recess, the locking ring can be inserted more deeply by the depth of the annular recess during locking, thus guaranteeing a reliable locking operation.

DETAILED DESCRIPTION

A snap-fit button according to one embodiment of this invention will now be described with reference to the accompanying drawings.

Figure 1:
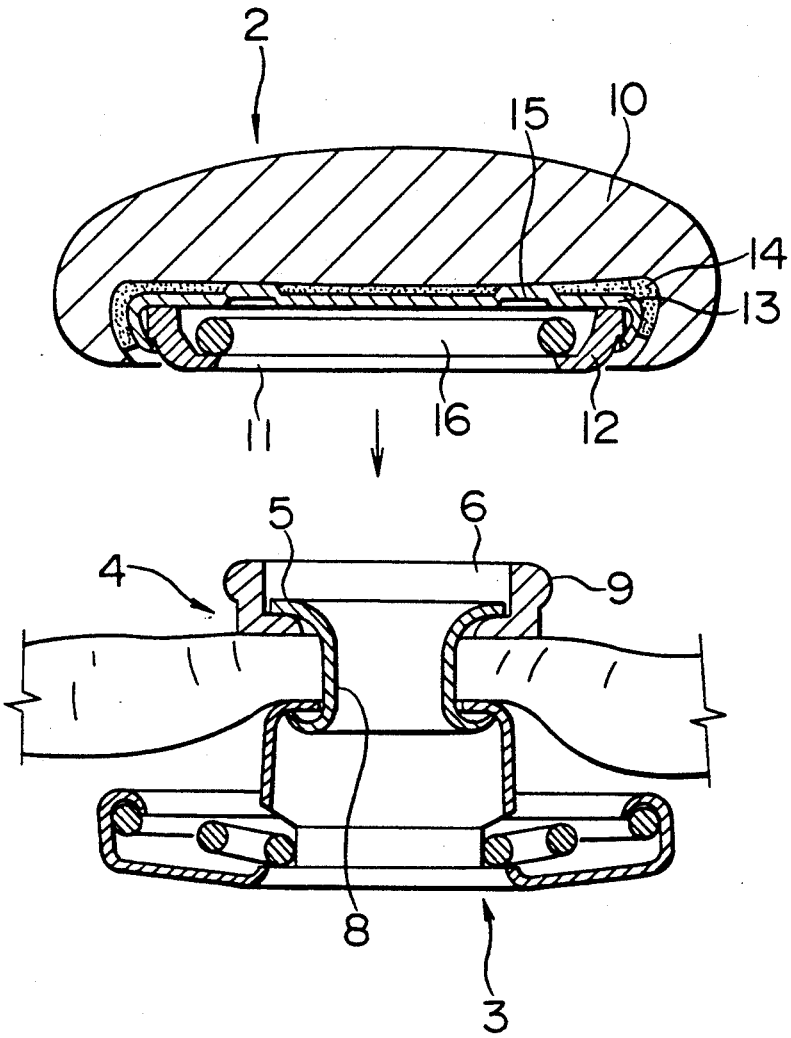
FIG. 1 is a cross-sectional view showing a snap-fit button before a button body and a locking ring are engaged with one another.
Figure 2:
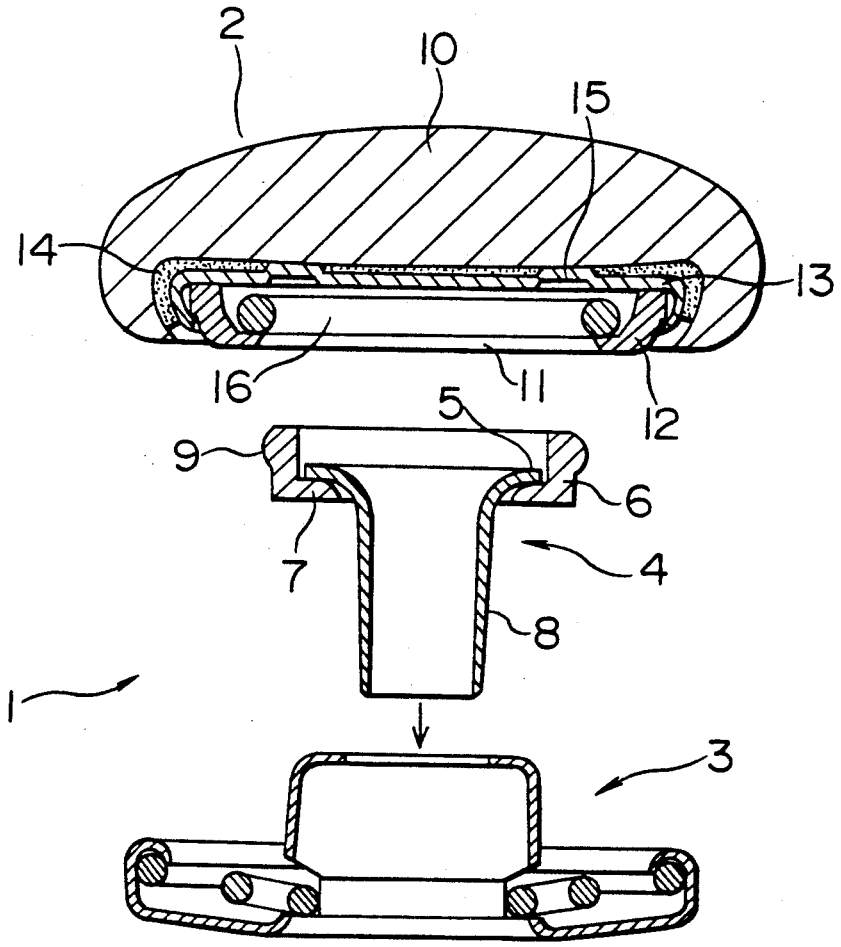
FIG. 2 is an exploded cross-sectional view of the snap-fit button before the button body and a female snap member are caulked with a connecting member.
Figure 3:
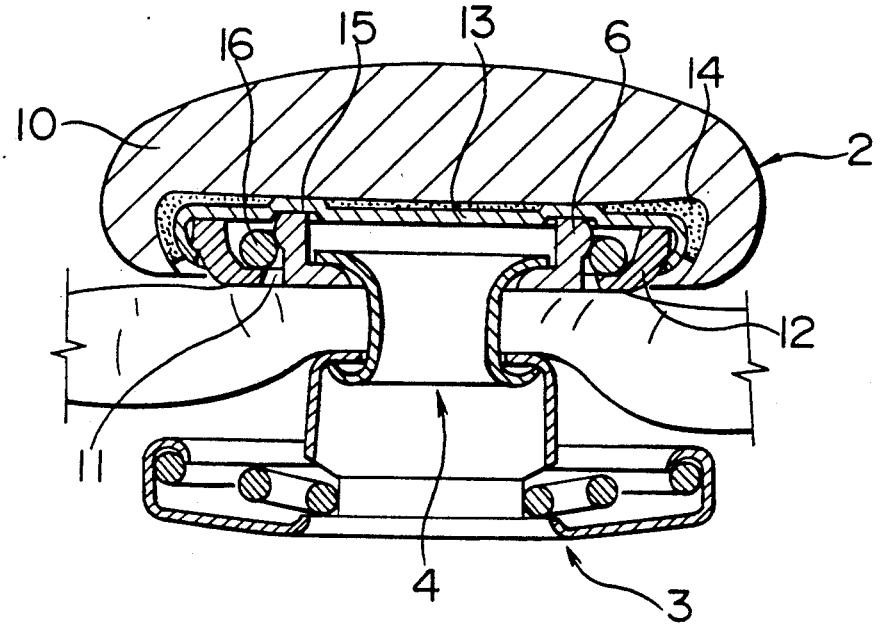
FIG. 3 is a cross-sectional view showing the snap-fit button after the button body and the locking ring have been engaged with one another.
Figure 4:
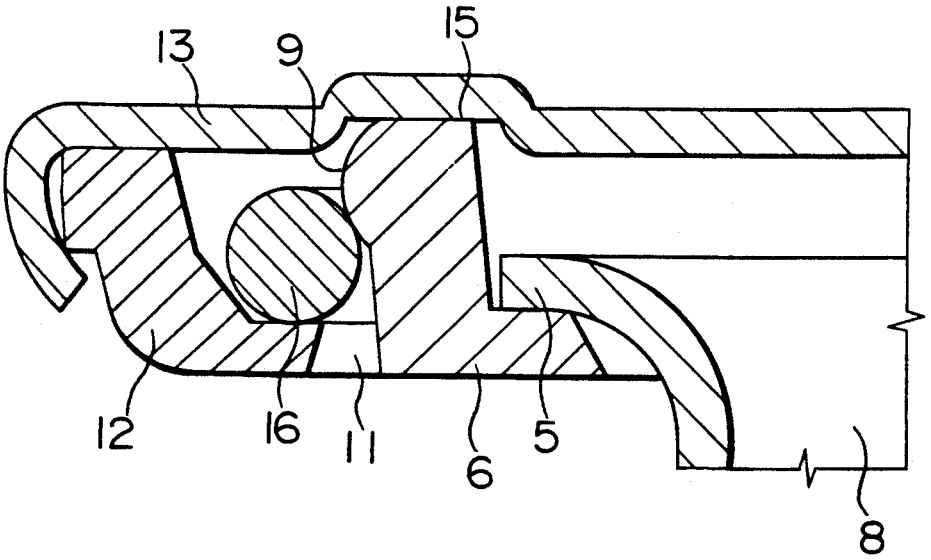
FIG. 4 is an enlarged cross-sectional view showing a main portion of FIG. 4.

A female snap-fit button 1 is a three-member structure, as shown in FIG. 2, which comprises a button body 2, a female snap member 3, and a connecting member 4. With a flange portion 7 of a locking ring 6 in engagement with a flange 5 of the connecting member 4, a tubular portion 8 is pierced through a cloth and is then clenched at its distal end against the female snap member 3 to sandwich the cloth; the female snap member 3 and the locking ring 6 are thus attached to the cloth. The locking ring 6 has a ridge 9 extending on and along its outer peripheral portion.

In the button body 2, a socket 12 having a central aperture 11, in which the locking ring 6 is to be inserted, is secured to the back surface of an ornamental 10 via a tray-shape cap 13, the socket 6 also having a taper diverging from an edge of the aperture 11 toward the back surface of the ornamental 10. The cap 13 is attached to the ornamental 10 with an adhesive 14 or the like and has on its flat portion an annular recess 15 so as to contact with the head portion of the locking ring 6. In the socket 12 a ring-shape spring 16 engageable with the locking ring 6 and having a diameter substantially equal to the aperture 11 is received.

In this illustrated embodiment, the invention is applied to a female snap-fit button. Alternatively the invention may be applied to a male snap-fit button if the button body is formed independently from the female or male snap member and is adapted to be joined therewith.

According to the snap-fit button of this invention, since the button body having an ornamental can be coupled with the locking ring which is already attached to the cloth of a garment or the like, a customer can select one from various kinds of ornamented buttons in stock according to the customer's taste when the customer purchases the garment or the like.

After the ring-shape spring within the socket of the button body has once engaged with the locking ring, the locking ring can no longer be removed even if a pulling force is exerted on the locking ring. This is true because the socket has a special shape, i.e. having a taper diverging from the edge of the aperture toward the back surface of the button body, and becomes recuded in size and hence much harder when pulled. Therefore this snap-fit button is free from missing of the ornamented button body, while the garment is in use, and hence is very practical, compared to the conventional button.

What is claimed is:

1. A snap-fit button comprising:

(a) a button body having on its front surface an ornamental;

(b) a snap member;

(c) a connecting member with which said button body and snap member are adapted to be connected;

(d) a locking ring having on and along its outer peripheral portion a ridge and attached to a flange of said connecting member;

(e) a socket having an aperture for receiving said locking ring and having a taper diverging from an edge of said aperture toward a back surface of said button body, said socket being secured to the back surface of said button body; and (f) a ring-shape spring disposed in said socket for resiliently engaging said locking ring.

2. A snap-fit button according to claim 1, wherein the back surface of said button has an annular recess so as to contact with a head portion of said locking ring.

* * * * *

UNITED STATES PATENT AND TRADEMARK OFFICE

CERTIFICATE OF CORRECTION

PATENT NO. : 5,212,851

DATED : May 25, 1993

INVENTOR(S) : Hirokazu Watanabe

It is certified that error appears in the above-identified patent and that said Letters Patent is hereby corrected as shown below:

On the title page, Item [75]: Inventor:"Hirokazu Wantanabe" should read --Hirokazu Watanabe--.

Signed and Sealed this

Eighth Day of March, 1994

Bruce Lehman

*Attest:*

BRUCE LEHMAN

*Attesting Officer*

*Commissioner of Patents and Trademarks*